US006164432A

United States Patent [19]

Monsees

[11] Patent Number: 6,164,432

[45] Date of Patent: Dec. 26, 2000

[54] APPARATUS FOR FEEDING ARTICLES

[75] Inventor: Claude E. Monsees, Fort Mill, S.C.

[73] Assignee: Roberts PolyPro, Inc., Charlotte, N.C.

[21] Appl. No.: 09/193,613

[22] Filed: Nov. 17, 1998

[51] Int. Cl.[7] ..... B65H 3/04

[52] U.S. Cl. ..... 198/459.4; 198/468.8; 271/305; 271/35; 414/798; 414/798.1

[58] Field of Search ..... 198/459.4, 468.8; 414/797.6, 798, 798.1, 795.6; 271/3.05, 35; 221/11

[56] References Cited

U.S. PATENT DOCUMENTS

| | | | |
|---|---|---|---|
| 4,134,330 | 1/1979 | Weickenmeier . | |
| 4,193,491 | 3/1980 | James et al. | 198/468.8 |
| 4,214,742 | 7/1980 | Martelli . | |
| 4,232,859 | 11/1980 | Tokuno | 414/797.6 |
| 4,591,044 | 5/1986 | Ogami et al. | 198/468.8 |
| 4,727,803 | 3/1988 | Nobuta et al. . | |
| 4,907,942 | 3/1990 | Pfeil | 414/798 |
| 4,961,566 | 10/1990 | Labombarde | 414/797.6 |
| 5,026,250 | 6/1991 | Hofer | 414/797.6 |
| 5,141,216 | 8/1992 | Ballestrazzi et al. | 198/468.8 |
| 5,295,675 | 3/1994 | Hain | 271/35 |
| 5,601,282 | 2/1997 | Milo et al. | 271/35 |
| 5,896,978 | 4/1999 | Spatafora | 198/468.8 |
| 5,941,517 | 8/1999 | Heiber et al. | 414/797.6 |

*Primary Examiner*—Douglas Hess
*Attorney, Agent, or Firm*—Hardaway/Mann IP Group Nexsen Pruet Jacobs & Pollard, LLP

[57] ABSTRACT

An apparatus for feeding articles, comprising: a surface; a plurality of conveyor belts spanning the surface; a motor driving the conveyor belts for transporting the articles along the surface; a barrier bar positioned above the surface for preventing further transport of the articles along the surface; and an actuator connected to at least one of the conveyor belts. The actuator raises at least a first portion of the conveyor belt a distance above the surface and lowers the conveyor belt back to the surface. Raising the actuator propels one of the articles past the block. The article feeding apparatus can be one component of a larger article handling system.

10 Claims, 4 Drawing Sheets

APPARATUS FOR FEEDING ARTICLES

BACKGROUND OF THE INVENTION

The present invention relates generally to an apparatus for feeding articles. Specifically, the invention relates to a conveyor table that dispenses an article from a stack of articles.

Numerous attempts at article feeders have been attempted. U.S. Pat. No. 4,134,330 to Weickenmeier describes an apparatus for stacking blanks. The apparatus uses a counter-register to count the number of blanks passing therethrough. After a given number of blanks, the apparatus utilizes a blank deflecting means to laterally deflect a blank. The deflected blank indicates the start of the next batch of blanks.

U.S. Pat. No. 4,214,742 to Martelli describes a device that feeds instruction sheets into a box during the formation of the box.

U.S Pat. No. 4,727,803 to Nobuta et al. describes a lifting device positioned between to conveyor belts. The lifting device raises a portion of the article off one of the conveyor belts. Raising one end of the article allows the article to be bound.

SUMMARY OF THE INVENTION

It is an object of the present invention to provide an improved article handling system.

It is a further object of the present invention to provide an improved article feeding apparatus in an article handling system.

It is a further object of the present invention to provide a conveyor table that dispenses a single article from a stack of articles.

It is a further object of the present invention to provide an article feeding apparatus that dispenses articles in metered fashion.

It is a further object of the present invention to provide an article feeding apparatus that dispenses one article from a stack of articles at a precise, adjustable timed interval.

It is a further object of the present invention to provide an article feeding apparatus that maintains a specified distance between each article dispensed from a stack of articles.

These and other objects are achieved in one aspect of the present invention by an apparatus for feeding articles, comprising: a surface; a plurality of conveyor belts spanning the surface; a motor driving the conveyor belts for transporting the articles along the surface; a barrier bar positioned above and across the surface for preventing further transport of a stack of articles along the surface; and an actuator means controlling the function of at least one of the conveyor belts. The actuator raises at least a portion of a conveyor belt a distance above the surface and lowers the conveyor belt back to the surface. Raising the actuator causes articles to pass the barrier bar one at a time.

These and other objects are achieved in a second aspect of the present invention by a conveyor table for transporting articles, comprising: a surface; at least one queuing conveyor belt spanning at least part of the surface; at least one feeding conveyor belt spanning at least part of the surface; a motor driving the queuing conveyor belt and the feeding conveyor belt for transporting the articles along the surface; a barrier bar positioned above the surface for preventing further transport of stacked articles along the surface by the queuing conveyor belt; a first actuator connected to the feeding conveyor belt to raise a first portion of the feeding conveyor belt a distance above said surface and to lower the feeding conveyor belt; a second actuator connected to the feeding conveyor belt at a location upstream of said first actuator, to raise a second portion of the feeding conveyor belt a distance above said surface and to lower the feeding conveyor belt. Raising the first and second actuators causes the feeding conveyor belts to propel one of the articles past the barrier bar. Lowering the first and second actuators causes the queuing conveyor belts to transport the articles along said surface only to said barrier bar.

These and other objects are achieved in a third aspect of the present invention by an article handling system, comprising: a hopper for holding a stack of articles; a prefeeder for receiving the articles from said hopper and for placing the articles in an overlapping relationship; an article feeder for receiving the overlapping articles from the prefeeder and dispensing one article at a time downstream; a folder/gluer for gluing the dispensed article and for folding the dispensed article to form a carton; and a case packer for receiving the carton from said folder/gluer and for placing the carton in a package. The article feeder comprises: a surface; a plurality of conveyor belts spanning the surface; a motor driving the conveyor belts for transporting the articles along the surface (queuing conveyor belt); a barrier bar positioned above the surface for preventing further transport of stacked articles along the surface; and an actuator connected to at least one of the conveyor belts (feeding conveyor belt) to raise a first portion of the conveyor belt a distance above said surface and to lower the first portion of the conveyor belt. Raising the actuator dispenses one of the stacked articles past the barrier bar.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF THE PREFERRED EMBODIMENTS

Figure 1:
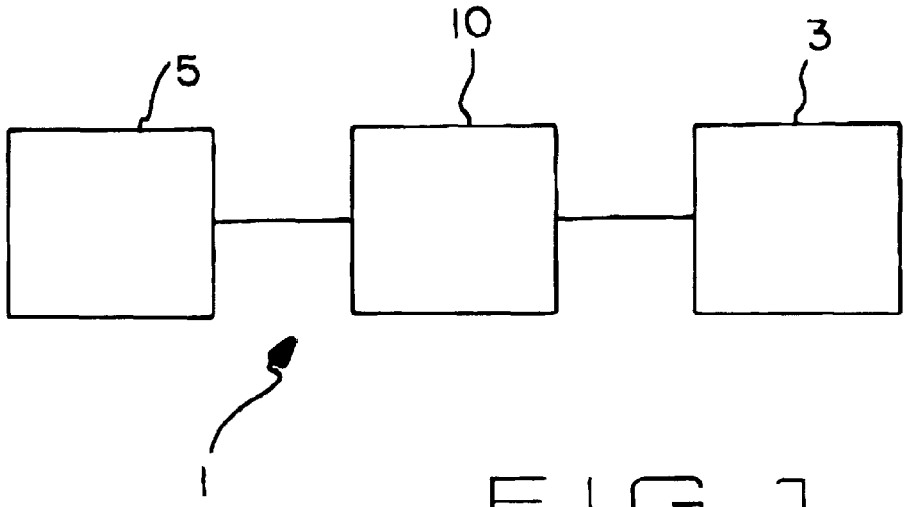
FIG. 1 is a schematic of an article handling system, one component of which is an article feeding apparatus of the present invention.

FIG. 1 provides a schematic of an article handling system 1. Article handling system 1 can use a variety of components. Article feeding apparatus 10 of the present invention is one component of article handling system 1. In addition to article feeding apparatus 10, article handling system 1 may include upstream components 3 and downstream components 5. The specific types of components 3, 5 used in article handling system I depend upon the nature of the task to be performed on article A.

Generally speaking, article handling system 1 can perform any series of conventional tasks to an article A being carried thereon. As an example, article handling system 1 could be a carton forming machine. Article handling system 1 would transform a blank into a carton in a series of conventional steps. Upstream components 3 would include a hopper (not shown) supplying a stack of blanks to a prefeeder (not shown) that arranges the blanks in an overlapping, or shingled, relationship. U.S. Pat. No. 5,238,239 to LaChapelle, herein incorporated by reference, demonstrates a prefeeder. Downstream components 5 may include a folder/gluer (not shown) that scores portions of the blank to create a flap, applies glue to the blank, and presses the flap against the blank. The folder/gluer performs the same tasks, either in series and/or in parallel, to other portions of the blank until a carton is formed. Downstream components 5 may also include a case packer (not shown) to place the cartons into packaging (not shown) for shipping. U.S. Pat. No. 5,720,156 to Bridges et al., herein incorporated by reference, demonstrates a case packer.

However, the present invention is not limited to the specific article handing system 1 discussed above. In fact, article feeding apparatus 10 could be used in any type of article handling system 1.

FIGS. 2–5 display one alternative embodiment of article feeding apparatus 10. A conveyor table 11 preferably has a hollow interior 21 formed by side walls 13, end walls 15, bottom surface 17 and upper surface 19.

Lip seals 35 project from the upper portion of side walls 15 and, preferably, reside along the entire length of table 11. Lip seals 35 engages a portion of article A as it travels along table 11. Lip seals 35 ensure that article A remains suitably positioned on table 11. Although table 11, in the preferred embodiment, does not use a vacuum, lip seals 35 can take advantage of a residual vacuum from a vacuum source on an upstream component 3 (if required by system 1) to retain article A against upper surface 19 of table 11. Lip seal 35 is preferably a low friction material, such as polytetrafluoroethylene. A fence, not shown, may be attached to sides 13 outside of the side seals.

Table 11 accommodates endless conveyor belts 23, 25. Conveyor belts 23, 25 are preferably made from a high friction material. Preferred are laminated belts having a web reinforcement and at least the surface disposed outwardly having a coating of a high tack rubber. Commercially available industrial belts such as LINOTEX™ are suitable. Each conveyor belt 23, 25 spans upper surface 19, with the remainder of each conveyor belt 23, 25 residing within interior 21. Conveyor belts 23, 25 engage a series of rollers 27, 29, 31 on table 11. Idler rollers 27 secure to table 11 in any conventional manner and are positioned within table 11 to allow conveyor belts 23, 25 unhindered movement along upper surface 19. Each conveyor belt 23, 25 may use its own separate idler roller 27 secured to table 11, or conveyor belts 23, 25 may use common idler rollers 27 that span hollow interior 21 and secure to side walls 13.

An adjustable roller 29 provides tension to conveyor belts 23, 25. Tension roller 29 may be adjustably secured to table 11 and provide tension to conveyor belts 23, 25 in any conventional manner. For example, tension roller 29 may be spring biased against conveyor belts 23, 25. Preferably, each conveyor belt 23, 25 uses its own separate tension roller 29 secured to table 11. Separate tension rollers 29 ensure that each conveyor belt 23, 25 is properly tensioned regardless of age or degree of stretching.

A drive roller 31 of a motor 33 propels conveyor belts 23, 25. Motor 33 is preferably electric. Further, article handling system 1 could include a conventional control system (not shown) that can, for example, selectively operate motor 33 at a desired speed based upon the type of article A carried on system 1, or the capacity of system 1. Each conveyor belt 23, 25 can use a separate motor, but a motor common to all conveyor belts 23, 25 is preferred, for example, to drive all conveyors 23, 25 at the same speed.

Figure 2:
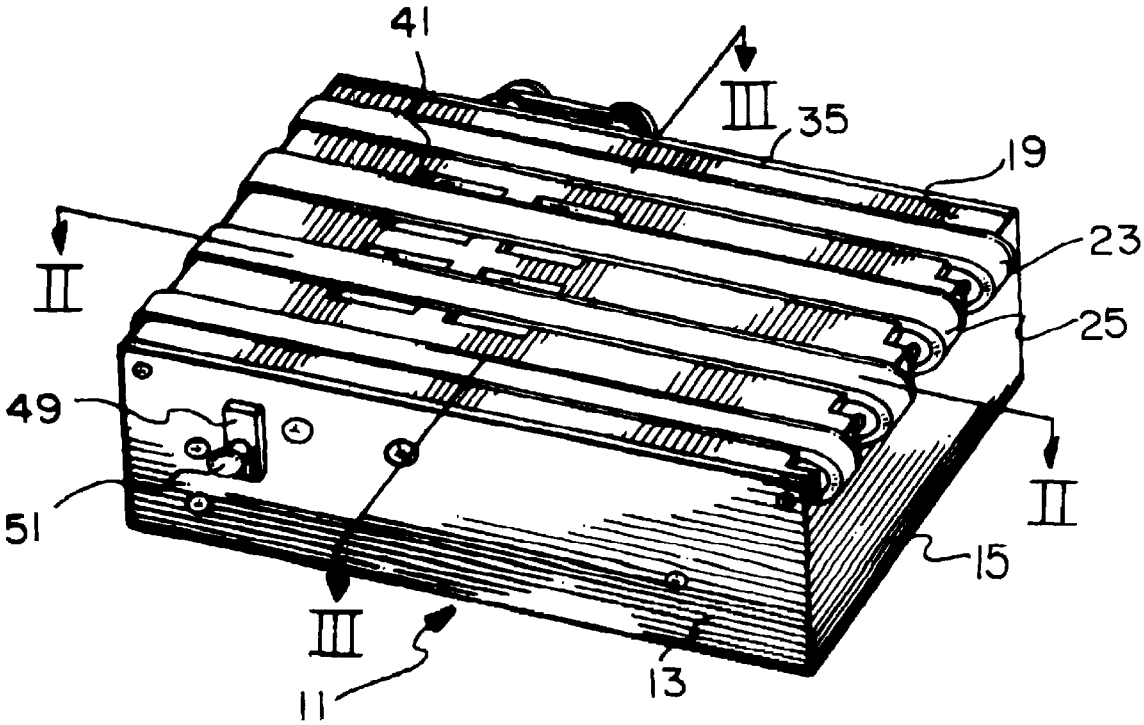
FIG. 2 is a perspective view of one alternative embodiment of the article feeding apparatus of the present invention.

Conveyor belts 23, 25 reside within channels 37, 39, respectively, extending along the length of upper surface 19 of table 11. As seen in FIG. 2, conveyor belts 25 are preferably centrally located on upper surface 19, flanked by conveyor belts 23. The upper surfaces of conveyor belts 23, 25 are roughly flush with the upper surfaces of lip seals 35 and the remainder of upper surface 19 of table 11. Preferably, the upper surfaces of conveyor belts 23, 25 are positioned just slighter higher than the upper surfaces of lip seals 35 and the remainder of upper surface 19 of table 11. This way, conveyor belts 23, 25 can propel, or queue, articles A along table 11 while article A also rests on lip seals 35 and upper surface 19 of table 11.

Since conveyor belts 23, 25 extend only slightly higher than lip seals 35 and the remainder of upper surface 19 of table 11, the weight (or force) normal on the belts from the stacked articles is limited. The progress of a stack of articles may be stopped by an obstruction.

System 1 uses an obstruction to movement of article A in order to sequence the supply of articles A to downstream components 5. The system uses a barrier bar 43 for this task. Barrier bar 43 conventionally secures to table 11 or a frame member (not shown) located near table 11 and is adjustably positionable at a selected distance above upper surface 19 of table 11. For example, a support frame 47 extends across table 11. Support frame 47 secures to brackets 49 on side walls 13. Support frame 47 slidably adjusts within bracket 49. A rotatable knob 51 locks support frame 47 within bracket 49 at its desired height above upper surface 19 of table 11.

In order to obstruct, but not damage, article A, barrier bar 43 is preferably positioned a distance above table 11 slightly greater than the thickness of article A but less than twice the thickness (e.g. 1.5 times the thickness). Barrier bar 43 may have a curvilinear front face 45 to retain the overlapping, or shingled, articles A supplied from upstream components 3 in a slightly staggered fashion.

The article feeding apparatus of this invention must function in a stepwise manner to cause individual articles in a stack to pass barrier bar 43. This is accomplished by providing a means to increase the friction between belts 25 and the bottom article in the stack. The means selected is one which lifts belts 25 and the stacked articles resting thereon a distance sufficient to increase the normal force on the belt until the force in the direction of travel past the barrier bar exceeds the frictional force between the bottom article and the barred articles stacked above it.

Figure 4:
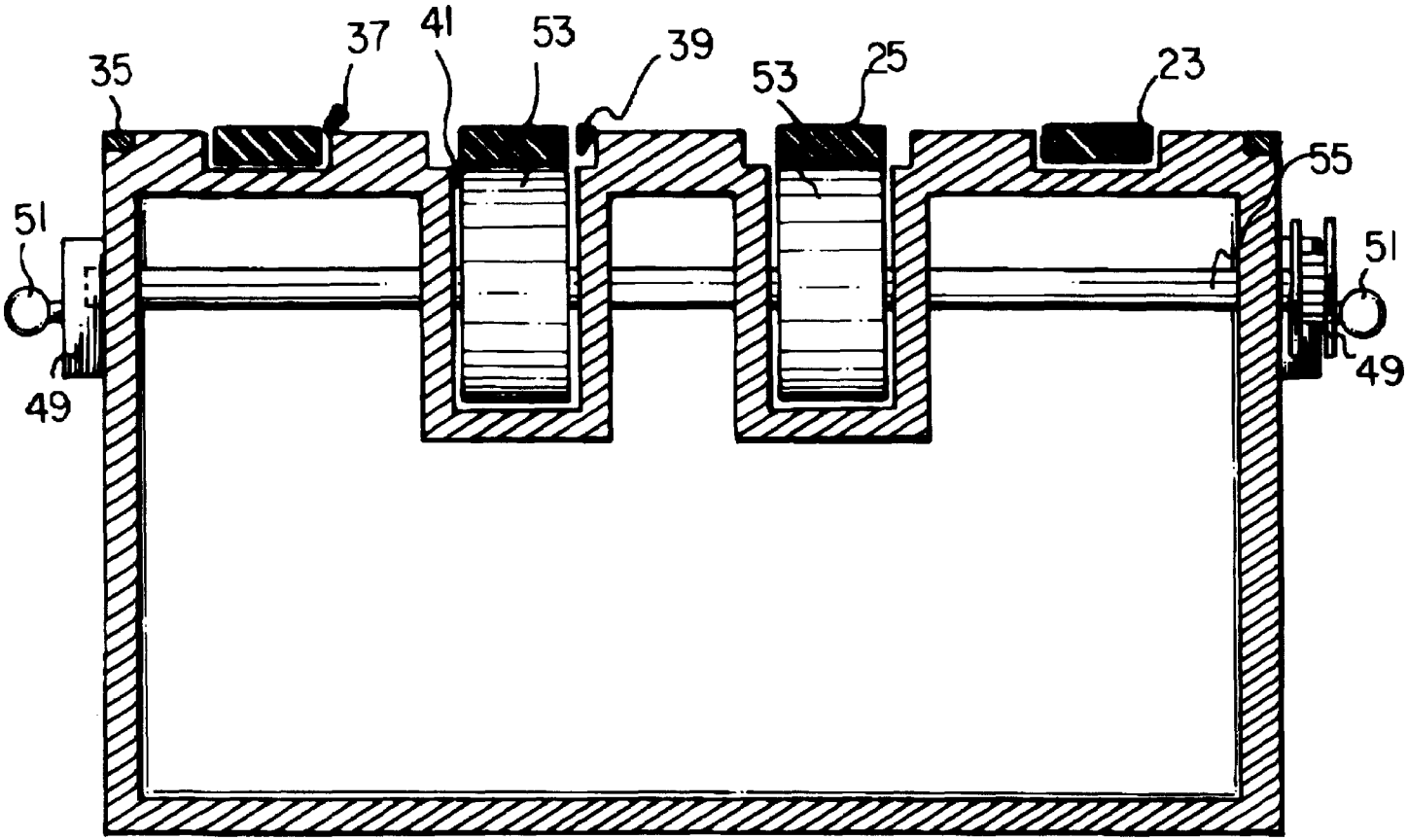
FIG. 4 is a cross-sectional view of the conveyor table taken along line III—III in FIG. 2 showing the eccentric cams of the actuation mechanism in a retracted position.

A suitable means must be reliable, easily timed, and readily adjusted for different sizes of article and different throughput rates. The preferred embodiment of this invention is described as follows:

Slightly different than channels 37, channels 39 include at least recesses 41 in the table 19. The actuation mechanism partially resides within recesses 41. As seen in FIG. 4, recesses 41 accommodate a cam 53 mounted on a shaft 55. Cam 53 preferably has a very low friction surface where it contacts conveyor belt 25.

Figure 3A:
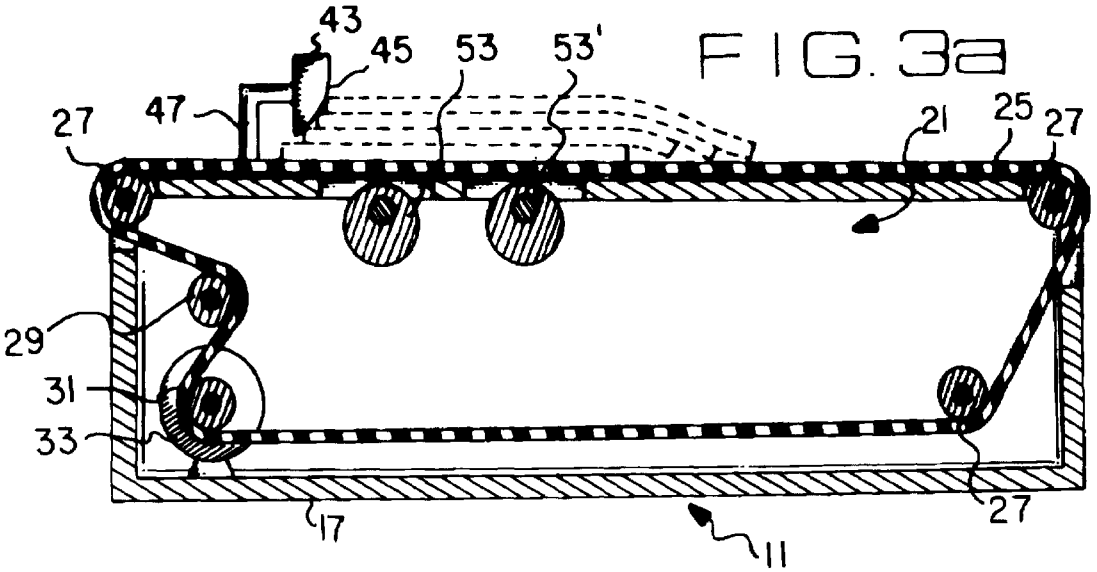
FIG. 3*a* is a cross-sectional view of the conveyor table taken along line II—II in FIG. 2 showing the eccentric cams of the actuation mechanism in a retracted position.
Figure 3B:
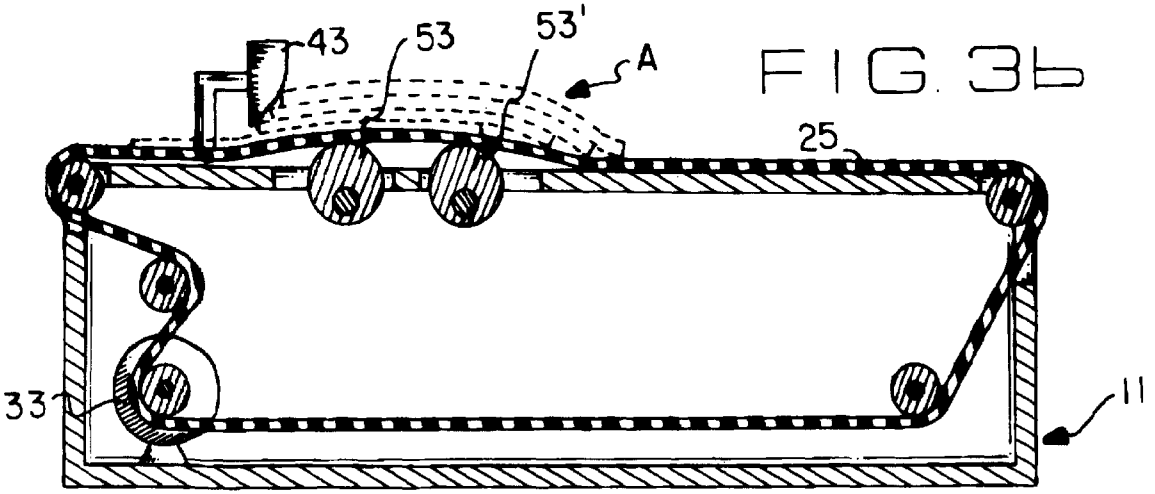
FIG. 3*b* is a cross-sectional view of the conveyor table similar to FIG. 3*a*, but showing the eccentric cams of the actuation mechanism in an extended position.

In the embodiment of FIGS. 3*a* and 3*b*, cam 53 is circular and is eccentrically mounted to shaft 55. Applicant recognizes the possibility of other cam arrangements such as a "teardrop" lobe. A circular cam is preferred because its design facilitates the use of needle or roller bearings between the cam and its circumferential face to reduce friction at the point of contact with the belt.

FIG. 4 shows the preferred arrangement in which shaft 55 secures to cams 53 of each conveyor belt 25. The use of a common shaft 55 ensures the same rotational rate of cam 53 for each conveyor belt 25. Applicant recognizes, however, that each cam 53 could have its own shaft 55.

Shaft 55 extends across hollow interior 21 and secures to side walls 13. Upon rotation of shaft 55, cam 53 starts a cycle that begins with conveyor belt 25 residing in channel 35. Cam 53 raises conveyor belt 25 from channel 39 to dispense the lowermost article A from the stack. Then, as cam 53 returns conveyor belt 25 into channel 39 to complete the cycle, the next article to be dispensed is staged.

Figure 5:
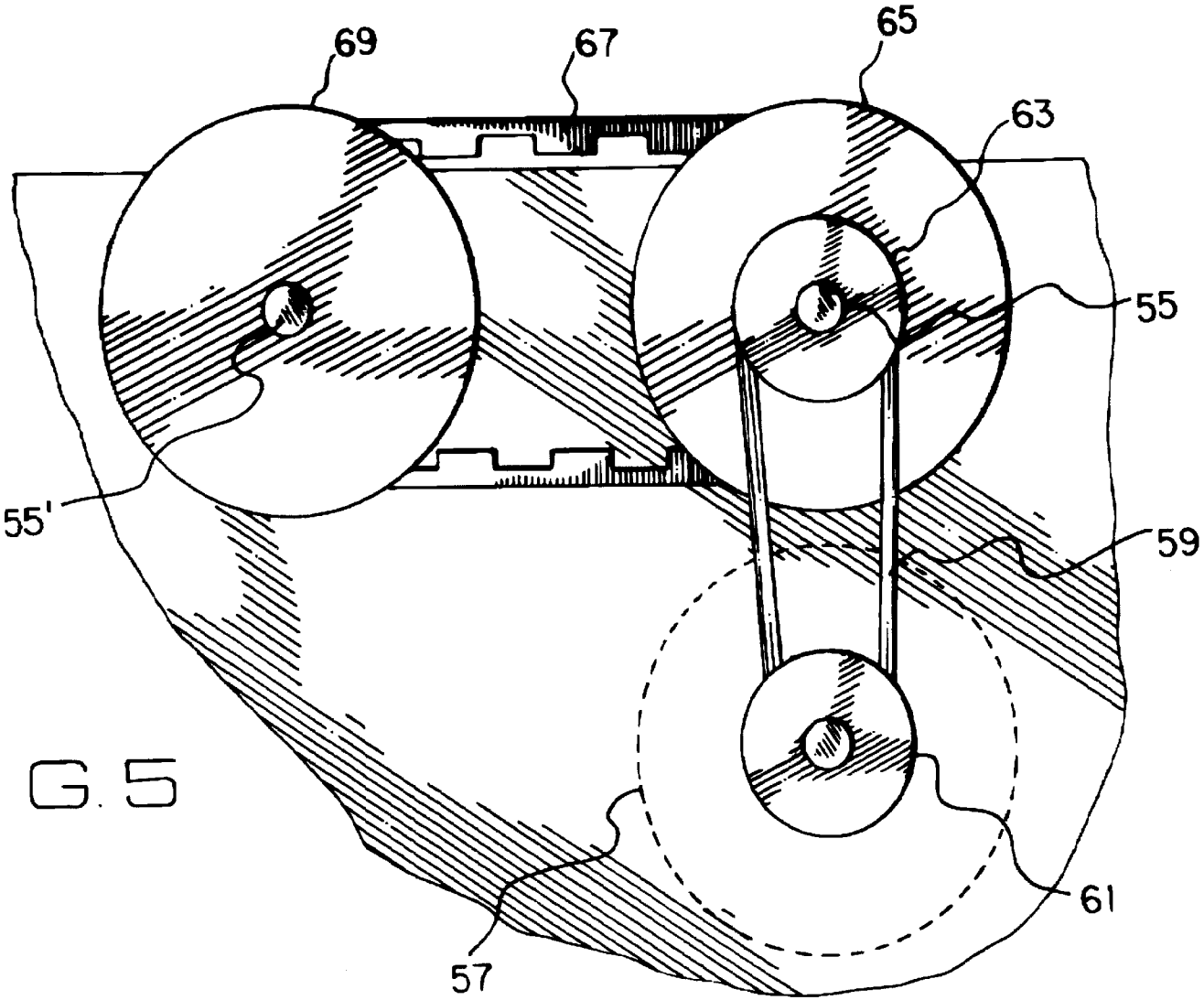
FIG. 5 is a detailed elevational view of a side of the conveyor table shown in FIG. 2 displaying one alternative embodiment of a drive mechanism for the conveyor belt actuation mechanism.

Referring to FIG. 5, a preferred method for cam actuation is described. A motor 57 rotates shaft 55 using conventional techniques. For example, motor 57 uses a belt 59 driven by a pulley 61 to transmit power to shaft 55. Shaft 55 carries a pulley 63 about which is wrapped belt 59. The relative sizes of the sheave 61 on motor 57 and sheave on shaft 55 determines the transmission ratio. Motor 57 can, for example, either secure to table 11 or to a frame (not shown) positioned near table 11. Optionally, a tension pulley may be used to compensate for wear.

Preferably, motor 57 is electric and could include a conventional control system (not shown) that can, for example, selectively manage the speed of motor 57. Controlling the speed of motor 57 directly affects the rate at which article feeding apparatus 10 dispenses articles A to downstream components 5 of system 1. Applicant recognizes that motor 57 could be directly coupled to shaft 55.

If each conveyor belt 25 uses a plurality of cams 53, 53', additional cams 53' also require motive power. The additional cams 53' could be driven by their own motor (not shown). However, FIG. 5 shows the preferred embodiment in which cams 53 and additional cams 53' all receive their motive power from motor 57.

As shown in FIG. 5, motor 57 transmits power to a common shaft, in this case camshaft 55. Conventional v-belt on sheaves may be used (61,63). A take-up pulley (not shown) may be used to adjust tension. It is critical that the phases of cams 53, 53' and any additional sets be synchronized. To this end, a chain or drive belt is used around suitable sprockets or wheels. Element 67 is illustrated as a reinforced rubber drive belt. Suitable tension adjustment may be used as required.

The operation of the above embodiment of article feeding apparatus 10 will now be described. As previously discussed, article feeding apparatus 10 is one component of article handling system 1. In a typical situation, article feeding apparatus 10 receives articles A in an overlapping, or shingled, relationship from upstream components 3.

To ensure proper operation of downstream components 5, article feeding apparatus must dispense a single article A from the stack of articles A. Furthermore, article feeding apparatus must maintain a certain distance between each article A dispensed. The distance and timing between the dispensing of articles A from article feeding apparatus 10 depends on numerous factors. For instance, the size of articles A and the speed of upstream components 3 and downstream components 5 are large factors in the timing and gap between the dispensing of articles A from article feeding apparatus 10.

Conveyor belts 23, 25 transport the stacked articles A along upper surface 19 of table 11. The presence of barrier bar 43 above table 11 prevents any forward movement of articles A. The bar 43 stops movement of articles A, while front face 45 maintains the bottom-most articles in an overlapping, or shingled, relationship.

The actuation mechanism meters the dispensing of articles A to downstream components 5. Motor 57 rotates shafts 55, 55', cycling cams 53, 53' located within recesses 41 of channel 39. Cams 53, 53' elevate a portion of conveyor belts 25 (belt 25 thereby becoming a feeder belt) from channel 39, advance the bottom article under bar 43 and staging the next article as the belts return to their starting position on the table.

The invention has been described in terms of a preferred embodiment. Many parameters area adjustable to optimize the application of the invention. For example, all or part of table 13 may be an air-tight plenum having a plurality of perforations on surface 19 to hold the article to the surface until mechanically lifted by cams 53. The number of belts lifted by cams may be changed (i.e. all belts may be queuing and feeder belts) and the number of rows of cams (i.e., number of cam shafts) may be altered depending upon the size, weight and flexibility of the article. It has been found that the cams must lift substantially the length of the article being fed to prevent bending or whipping of light articles and to avoid concentration of forces on small areas of the surfaces of the article being fed. The cams may operate in the same phase, different phases, and may have different lifts and durations. The size and profile of the barrier bar may be optimized to the properties of the article. The cams may be replaced by alternative lifting devices and the control thereof may be hydraulic or pneumatic instead of mechanical.

In addition, Applicants understand that many other variations are apparent to one of ordinary skill in the art from a reading of the above specification. Such variations are within the spirit and scope of the instant invention as defined by the following appended claims.

We claim:

1. A conveyor table for transporting articles, comprising:

a surface;

at least one queuing conveyor belt spanning said surface;

at least one feeding conveyor belt spanning said surface;

a motor driving said at least one queuing conveyor belt and said at least one feeding conveyor belt for transporting the articles along said surface;

a barrier bar positioned above said surface for preventing further transport of the articles along said surface by said at least one queuing conveyor belt; and a first actuator contacting to said at least one feeding conveyor belt to raise a first portion of said at least one feeding conveyor belt a distance above said surface and to lower said at least one feeding conveyor belt;

a second actuator contacting to said at least one feeding conveyor belt at a location upstream of said first actuator, said second actuator raising a second portion of said at least one feeding conveyor belt a distance above said surface and lowering said at least one feeding conveyor belt;

wherein raising said first and second actuators causes said at least one feeding conveyor belt to propel one of the articles past said barrier bar; and lowering said first and second actuators causes said at least one queuing conveyor belt to transport the articles along said surface.

2. The conveyor table for transporting articles as recited in claim 1, wherein said first and second actuators each comprise:

a cam positioned beneath said at least one feed conveyor belt; and a motor driving said cam.

3. The conveyor table for transporting articles as recited in claim 2, wherein said first and second actuators each further comprise a shaft connected to said cam driving motor and upon which said cams are eccentrically mounted.

4. The conveyor table for transporting articles as recited in claim 2, wherein said first and second actuators operate in the same phase.

5. The conveyor table for transporting articles as recited in claim 2, wherein said first and second actuators operate out of phase.

6. The conveyor table for transporting articles as recited in claim 1, further comprising lip seals extending along lateral edges of said surface for retaining the articles on said surface.

7. The conveyor table for transporting articles as recited in claim 1, wherein said surface includes a plurality of channels therealong receiving said at least one queuing conveyor belt and said at least one feeding conveyor belt, at least one of said plurality of channels including a plurality of recesses, each receiving a respective one of said first and second actuators.

8. The conveyor table for transporting articles as recited in claim 1, wherein said at least one queuing conveyor belt comprises a plurality of queuing conveyor belts flanking said at least one feeding conveyor belt.

9. A method for feeding articles from a stack comprising:

a) sliding stacked articles along a surface of a table by means of at least one belt running along the surface of said table;

b) stopping said stacked articles by means of a barrier bar mounted transversely to the belt direction and at a height above the top surface of the bottom article in the stack;

c) raising the at least one belt beneath the stack to a height and for a time sufficient for one article to pass beneath said transverse bar;

d) lowering the at least one belt to prevent additional articles from passing; and repeating step c and d.

10. An apparatus according to claim 9 wherein the means for raising and lowering the at least one belt is comprised of rotating cams disposed beneath said belt, said cams being sufficient in number that the at least one belt is raised under substantially the full length of said article being advanced during a part of each cycle.

* * * * *